US007401432B2

(12) United States Patent
Perry

(10) Patent No.: US 7,401,432 B2
(45) Date of Patent: Jul. 22, 2008

(54) HANDGUN TOOL AND RELATED METHODS

(75) Inventor: Sue A. Perry, Titusville, FL (US)

(73) Assignee: Perry Competition Inc., Titusville, FL (US)

( * ) Notice: Subject to any disclaimer, the term of this patent is extended or adjusted under 35 U.S.C. 154(b) by 426 days.

(21) Appl. No.: 11/135,106

(22) Filed: May 23, 2005

(65) Prior Publication Data

US 2006/0260170 A1 Nov. 23, 2006

(51) Int. Cl.
*F41C 27/00* (2006.01)

(52) U.S. Cl. ..... 42/108; 42/70.11; 42/70.01

(58) Field of Classification Search ..... 42/108, 42/107, 106, 70.11, 70.1, 90; 81/121.1, 124.6, 81/125.1; D22/108
See application file for complete search history.

(56) References Cited

U.S. PATENT DOCUMENTS

| | | | | | |
|---|---|---|---|---|---|
| D103,579 | S | * | 3/1937 | McNaught et al. | D8/28 |
| 4,037,275 | A | | 7/1977 | Schor | 7/1 G |
| 4,483,060 | A | | 11/1984 | Farrar et al. | 29/278 |
| 4,674,218 | A | | 6/1987 | Bottomley | 42/95 |
| 4,819,289 | A | | 4/1989 | Gibbs | 7/118 |
| 4,878,306 | A | | 11/1989 | Dyer | 42/90 |
| 4,901,411 | A | | 2/1990 | Chestnut et al. | 29/1.1 |
| 4,930,240 | A | | 6/1990 | Bice | 42/95 |
| 5,261,136 | A | | 11/1993 | Hall | 7/165 |
| 5,419,069 | A | * | 5/1995 | Mumbleau et al. | 42/70.11 |
| D407,958 | S | | 4/1999 | Royse, III | D8/16 |
| D422,467 | S | * | 4/2000 | Mollack | D8/28 |
| 6,230,430 | B1 | * | 5/2001 | Gosselin | 42/90 |
| 6,430,862 | B1 | | 8/2002 | Berlin | 42/90 |
| 6,904,634 | B2 | * | 6/2005 | Smith | 7/128 |
| 7,174,667 | B2 | * | 2/2007 | Connal | 42/108 |
| 7,240,450 | B2 | * | 7/2007 | Shober | 42/108 |
| 2004/0011100 | A1 | * | 1/2004 | Ross et al. | 70/408 |

* cited by examiner

*Primary Examiner*—Michael J. Carone
*Assistant Examiner*—Benjamin P Lee
(74) *Attorney, Agent, or Firm*—Allen Dyer Doppelt Milbrath & Gilchrist

(57) ABSTRACT

A handgun tool for use with a handgun including a barrel, a recoil spring and associated spring plug adjacent the barrel, and a barrel bushing retaining the spring plug and being rotatable between locked and unlocked positions. The handgun tool may include a handle body having at least one bushing-receiving recess therein for engaging the barrel bushing and rotating the barrel bushing between the locked and unlocked positions as the handle body is rotated. The handgun tool may further include an elongate alignment member carried by the handle body to be positioned into the barrel to align rotation of the handle body with the barrel.

18 Claims, 7 Drawing Sheets

HANDGUN TOOL AND RELATED METHODS

FIELD OF THE INVENTION

The present invention relates to the field of firearms, and, more particularly, to tools for servicing handguns and related methods.

BACKGROUND OF THE INVENTION

Handguns often require disassembly for cleaning, repair, or inspection. By way of example, disassembly of a 1911-style pistol is performed by first checking to make sure the gun is not loaded, and then using a tool called a bushing wrench to rotate the barrel bushing from a locked position to an unlocked position. That is, in the locked position the barrel bushing locks the spring plug in place, and the spring plug in turn holds the recoil spring within the spring cavity. In the unlocked position, the spring plug and spring may be removed from the spring cavity, and the remaining components of the pistol may then be disassembled. These steps are performed in reverse to re-assemble the pistol.

One example of a prior art bushing wrench is disclosed in U.S. Pat. No. 4,901,411 to Chestnut et al. The bushing wrench includes a wide flange to prevent uncontrolled ejection of the freed plug and spring. The tool generally resembles a ring or box-end wrench which includes a first end with a recess for partially receiving the spring plug of a pistol and an opening for receiving the barrel bushing of the pistol. Studs are positioned on the first end to control the amount and/or direction of rotation of the bushing or plug.

U.S. Pat. No. 6,430,862 to Berlin discloses a plug insertion and removal tool for a handgun. The tool includes a handle, a "scoop member" attached to the handle, and a plug depressing member attached to the handle and disposed within the scoop. The scoop member fits around the bottom of the barrel shroud in which the plug is located. To remove the plug, the user places the scoop member around the bottom of the barrel shroud and depresses the plug while rotating the handle toward the barrel.

Despite the availability of such tools, there is a need for barrel bushing tools which are relatively easy to align with and rotate the barrel bushing of a handgun in a safe manner which avoids unintentional ejection of the spring plug by the recoil spring.

SUMMARY OF THE INVENTION

In view of the foregoing background, it is therefore an object of the present invention to provide a handgun tool which allows for safe and convenient assembly and disassembly of a handgun.

This and other objects, features, and advantages in accordance with the present invention are provided by a handgun tool for use with a handgun including a barrel, a recoil spring and associated spring plug adjacent the barrel, and a barrel bushing retaining the spring plug and being rotatable between locked and unlocked positions. More particularly, the handgun tool may include a handle body having at least one bushing-receiving recess therein for engaging the barrel bushing and rotating the barrel bushing between the locked and unlocked positions as the handle body is rotated. The handgun tool may further include an elongate alignment member carried by the handle body to be positioned into the barrel to align rotation of the handle body with the barrel.

The handle body may have a shape defining an axis aligned with an axis of the elongate alignment member. By way of example, the handle body may have a cylindrical shape, and the cylindrical shape may define a radius larger than a radial extent of the at least one bushing-receiving recess. Thus, the radius may be large enough so that the handle body maintains contact with the spring plug while the handle body is rotated between the locked and unlocked positions. This advantageously blocks the spring plug from being ejected by the force of the recoil spring. Moreover, positioning the elongate alignment member in the barrel provides added stability and keeps the handle body substantially perpendicular to the barrel, further reducing the risk of a forced ejection of the spring plug.

In addition, the at least one barrel-bushing recess may comprise different-sized first and second barrel-bushing recesses. Moreover, the handle body may have opposing first and second ends, and the first and second barrel-bushing recesses may be on respective opposing first and second ends of the handle body. Also, the elongate alignment member may be selectively mountable to either of the opposing first and second ends of the handle body. Furthermore, the elongate alignment member may be a shaft having a proximal end connected to the handle body and a distal end, and a cleaning attachment (e.g., cleaning brush, cleaning cloth holder, etc.) may advantageously be carried by the distal end of the shaft.

A method aspect of the invention is for assembling/disassembling a handgun, such as the one described briefly above. The method may include manipulating a handle body of a handgun tool so that an elongate alignment member carried by the handle body is positioned into the barrel and so that at least one bushing-receiving recess of the handle body engages the barrel bushing. The method may further include rotating the handle body so that the barrel bushing moves between the locked and unlocked positions.

DETAILED DESCRIPTION OF THE PREFERRED EMBODIMENTS

Figure 1:
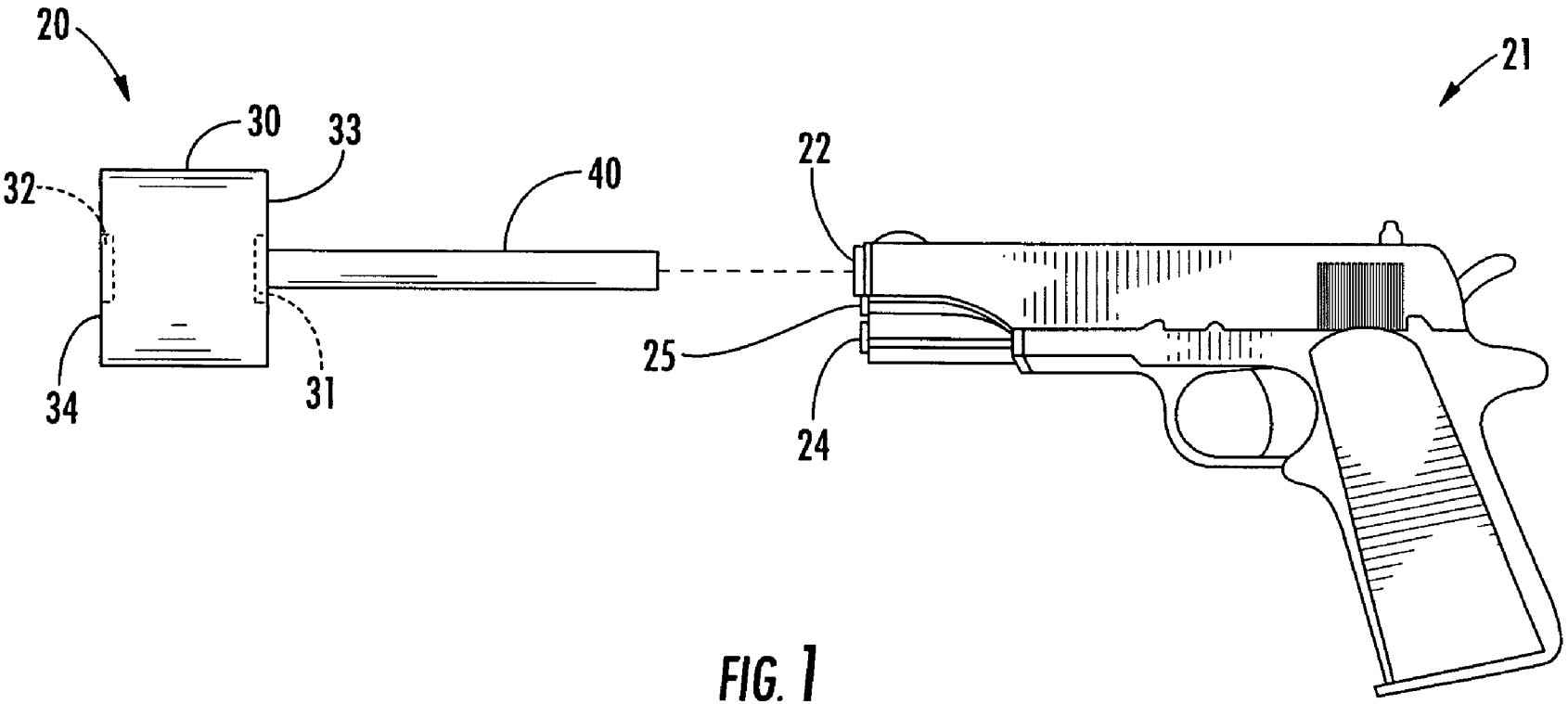
FIG. 1 is side view of a handgun tool in accordance with the present invention adjacent a handgun to be disassembled therewith.
Figure 2:
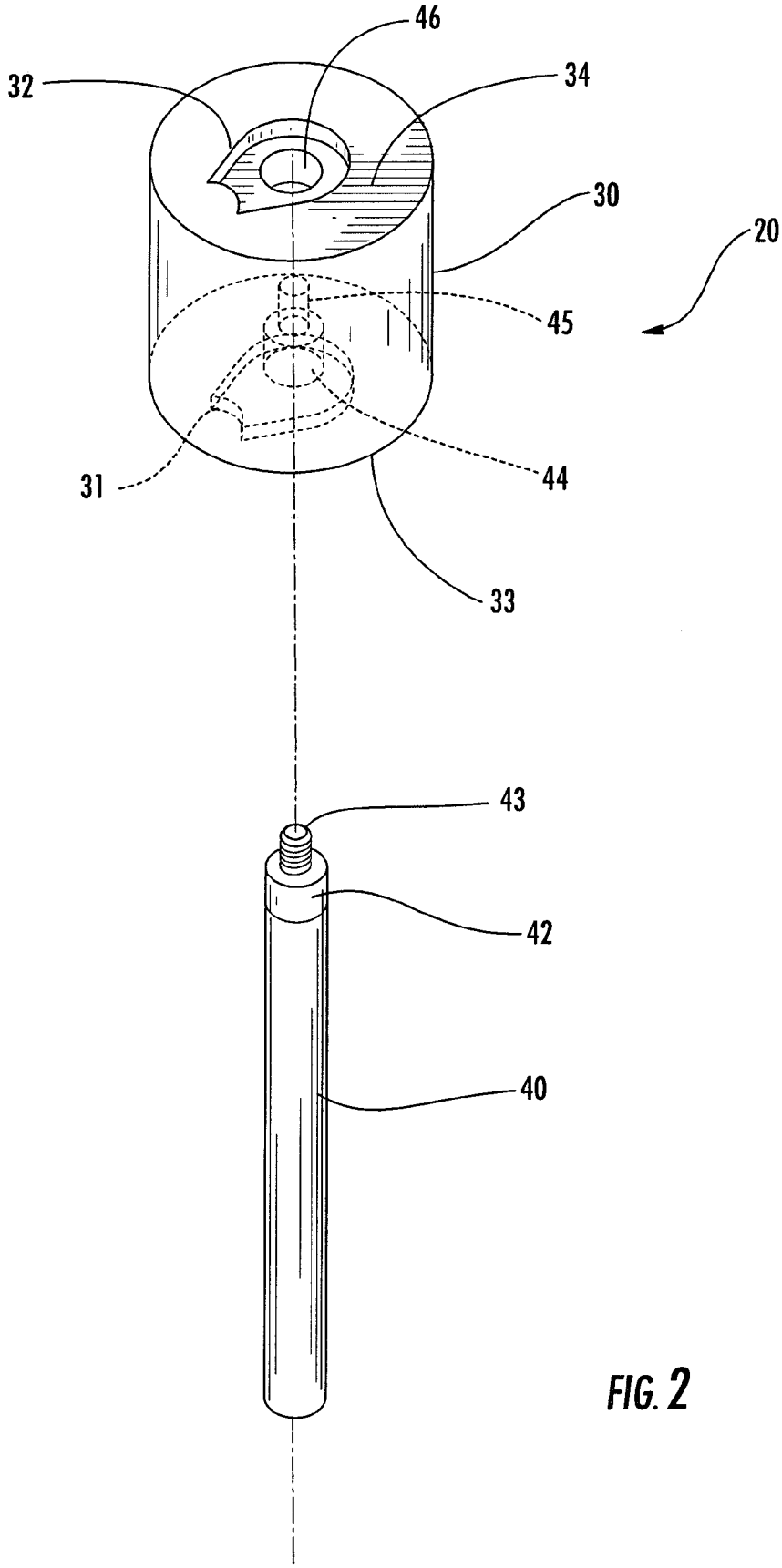
FIG. 2 is an exploded perspective view of the handgun tool of FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation indicates similar elements in different embodiments.

Referring initially to FIGS. 1 through 6, a handgun tool 20 in accordance with the present invention is for use with a handgun 21. In the illustrated example, the handgun 21 is a 1911-style pistol that includes a barrel 22, a recoil spring 23 and associated spring plug 24 adjacent the barrel, and a barrel bushing 25. The remaining components of the handgun 21 are well known in the art and require no further discussion herein. It should be noted that the handgun tool 20 may be used with handguns other than 1911-style pistols and with handguns of different calibers, as will be appreciated by those skilled in the art from the following discussion.

Figure 5:
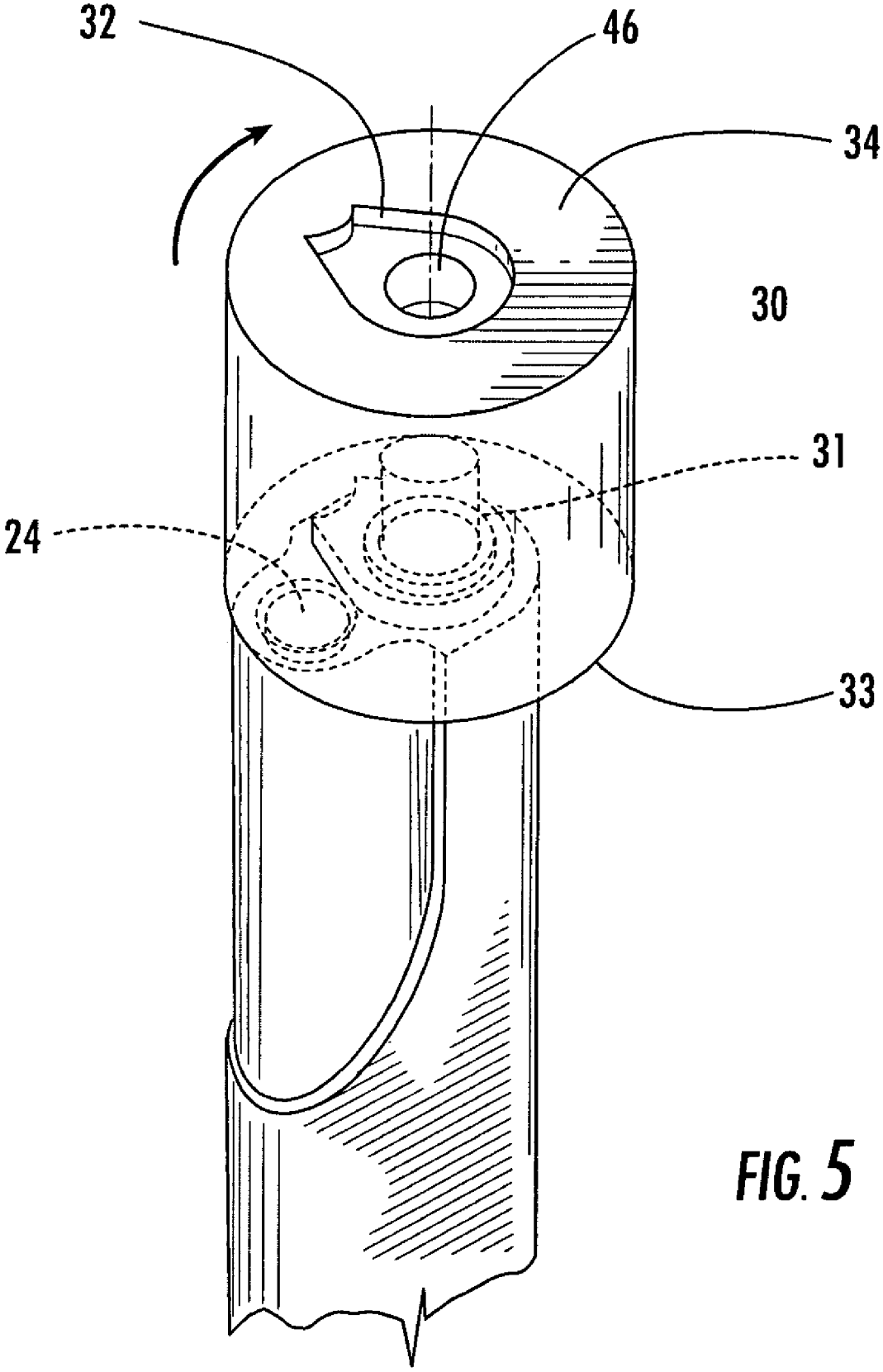

To disassemble the handgun 21, the barrel bushing 25 is rotated from a locked position (shown FIG. 3) to an unlocked position (shown in FIG. 5). In the locked position, the barrel bushing 25 engages a rim 26 of the spring plug 24 to hold the spring plug, and thus the recoil spring 23, in place within the spring cavity of the handgun 21. In the unlocked position, the barrel bushing 25 does not engage the rim 26 of the barrel bushing 24, and the spring plug 24 and recoil spring 23 may be removed from the handgun 21.

The handgun tool 20 illustratively includes a cylindrically-shaped handle body 30 having first and second bushing-receiving recesses 31, 32 on respective end surfaces 33, 34 of the handle body. It should be noted, however, that bushing-receiving recesses need not be included on both end surfaces 33, 34 in all embodiments (i.e., a single bushing-receiving recess may be used). However, the illustrated implementation is particularly advantageous in that the first and second bushing-receiving recesses 31, 32 are sized differently for different types of barrel bushings. That is, the first bushing-receiving recess 31 is for a standard 1911 auto barrel bushing, while the second bushing-receiving recess is for a Colt Officer ACP model pistol, as will also be appreciated by those skilled in the art, which are two common brushing sizes.

The handgun tool 20 further illustratively includes an elongate alignment member 40 carried by the handle body 30. In the illustrated embodiment the elongate alignment member 40 is a shaft that is positioned into the barrel 22 of the handgun 21 to align rotation of the handle body 30 with the barrel. To this end, the handle body 30 preferably has a shape defining an axis 41 (FIG. 3) aligned with an axis of the elongate alignment member. While the exemplary handle body 30 is cylindrical, other shapes may also be used. For example, an elongated handle body with a generally square cross-section and rounded corners or a cross-section with numerous flat sides (e.g., an octagon), as well as others, are possible. With some shapes it would be possible to include more that two bushing-receiving recesses, if desired, as will be appreciated by those skilled in the art. Similarly, the elongate alignment member 40 need not be cylindrical in all embodiments and may instead take other shapes, as will be appreciated by those skilled in the art.

The handle body 30 preferably defines a radius larger than a radial extent of the bushing-receiving recesses 31 and 32. Thus, the radius may be large enough so that outer portions of the first end surface 33 (and the second end surface 34 as well) maintain contact with the spring plug 24 while the handle body 30 is rotated between the locked and unlocked positions. This advantageously blocks the spring plug 24 from being ejected by the force of the recoil spring 23, as perhaps best seen in FIGS. 4 and 5. Moreover, positioning the elongate alignment member 40 in the barrel 22 provides added stability and keeps the handle body 30 substantially perpendicular to the barrel 22, further reducing the risk of a forced ejection of the spring plug 25.

Also, the elongate alignment member 40 may be selectively mountable to either of the first and second end surfaces 33, 34 of the handle body 30 depending upon the type of handgun to be assembled/disassembled and, thus, the type of bushing-receiving recess 31, 32 that is required. Furthermore, the elongate alignment member 40 may have a proximal end 42 with a threaded tip 43 to be received in a proximal end receiving recess 44 and a threaded tip receiving recess 45, respectively, as shown. Other connection configurations between the elongate alignment member 40 and the handle body 30 may also be used, although the threaded connection is advantageous in that it provides a sturdy connection that also allows for ease of removal and reattachment. This in turn makes it easier to interchange different elongate alignment members 40 of different sizes (i.e., diameters) and lengths for handguns of different calibers or types, as will be appreciated by those skilled in the art.

Figure 3:
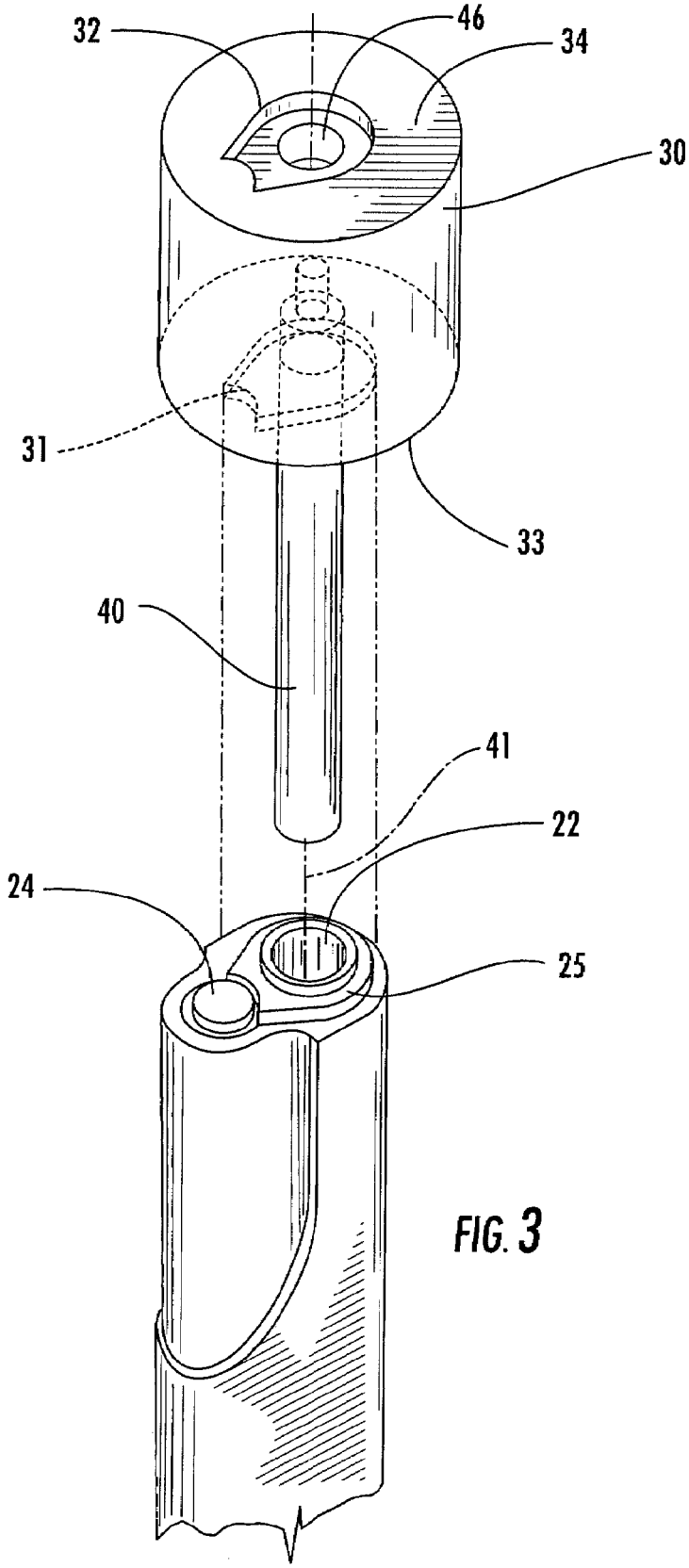
FIGS. 3-6 are a series of perspective views illustrating a method for assembling/disassembling a handgun using the handgun tool of FIG. 2.
Figure 4:
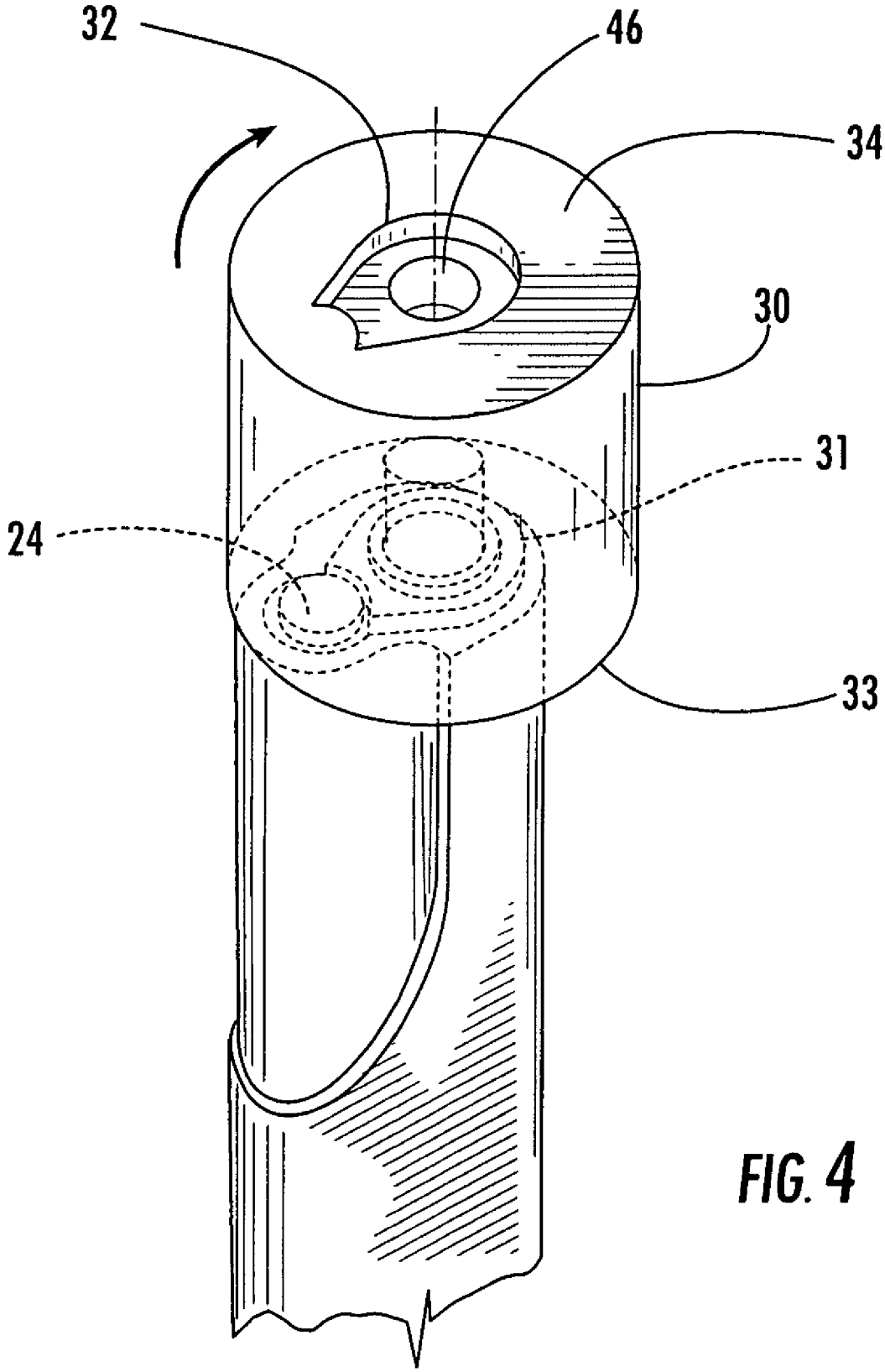

The proximal end receiving recess 44 and the threaded tip receiving recess 45 are positioned within the bushing-receiving recess 31 such that the bushing-receiving recess aligns with the barrel bushing 25 when the elongate alignment member 40 is in the barrel 22 and the attached handle body 30 is rotated to the correct position, as seen in FIGS. 3 and 4. Another proximal end receiving recess 46 and threaded tip receiving recess (not shown) are similarly located within the second bushing-receiving recess 32 for attaching the elongate alignment member 40 to extend from the second end surface 34 of the handle body 30 when the second bushing-receiving recess is to be used.

Figure 7:
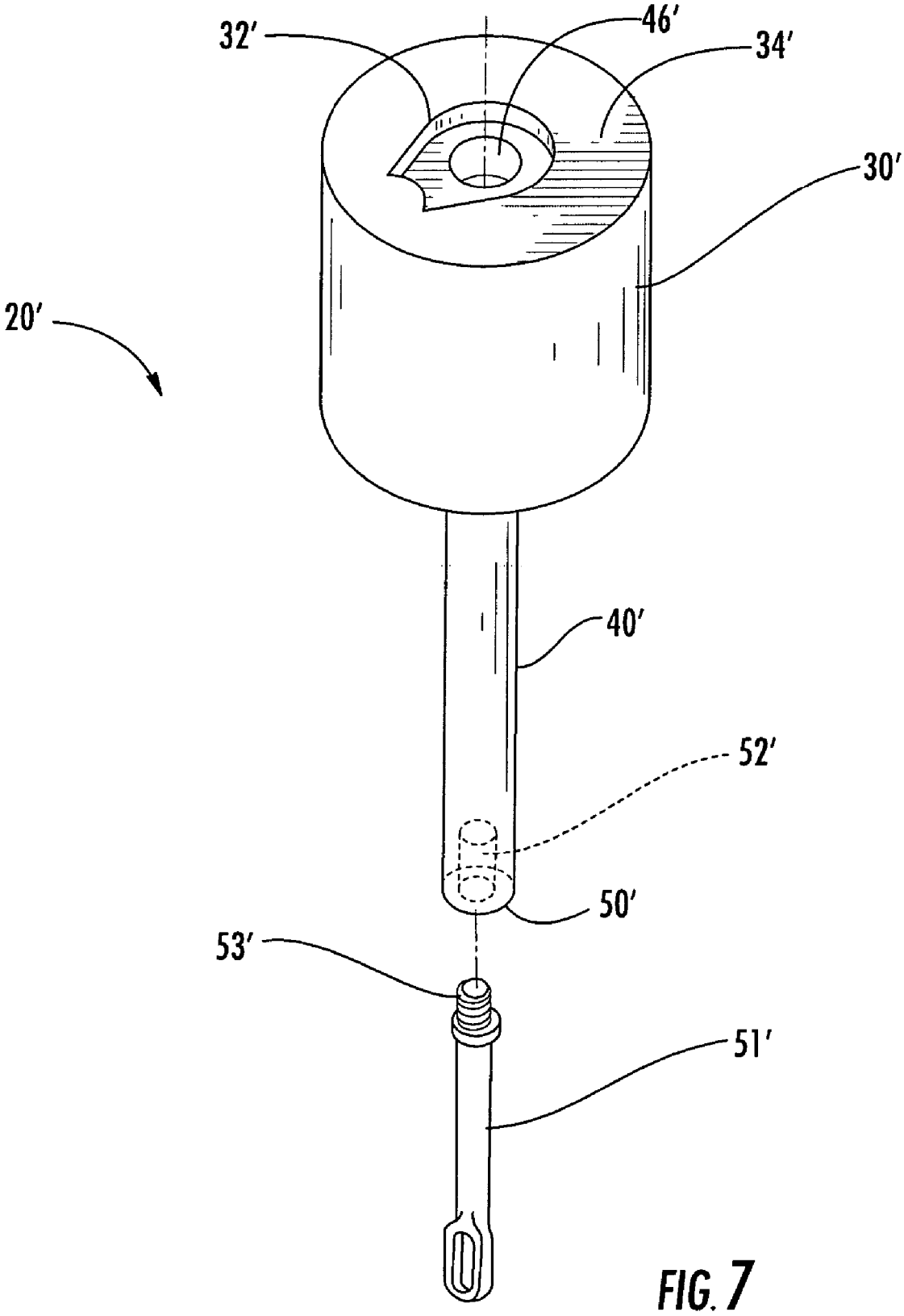
FIG. 7 is an exploded perspective view of an alternate embodiment of the handgun tool of FIG. 2 including a cleaning attachment.

In an alternate embodiment of the handgun tool 20' discussed now with reference to FIG. 7, a distal end 50' of the elongate alignment member 40' may have a cleaning attachment 51' attached thereto. More particularly, a threaded attachment recess 52' may be located at the distal end for receiving a corresponding threaded tip 53' of the cleaning attachment 51'. As will be appreciated by those skilled in the art, numerous industry standard cleaning tools with common threaded tips are available for cleaning handguns, such as barrel brushes, barrel mops, etc., all of which may advantageously be interchangeably attached to the elongate support member 40'.

Figure 6:
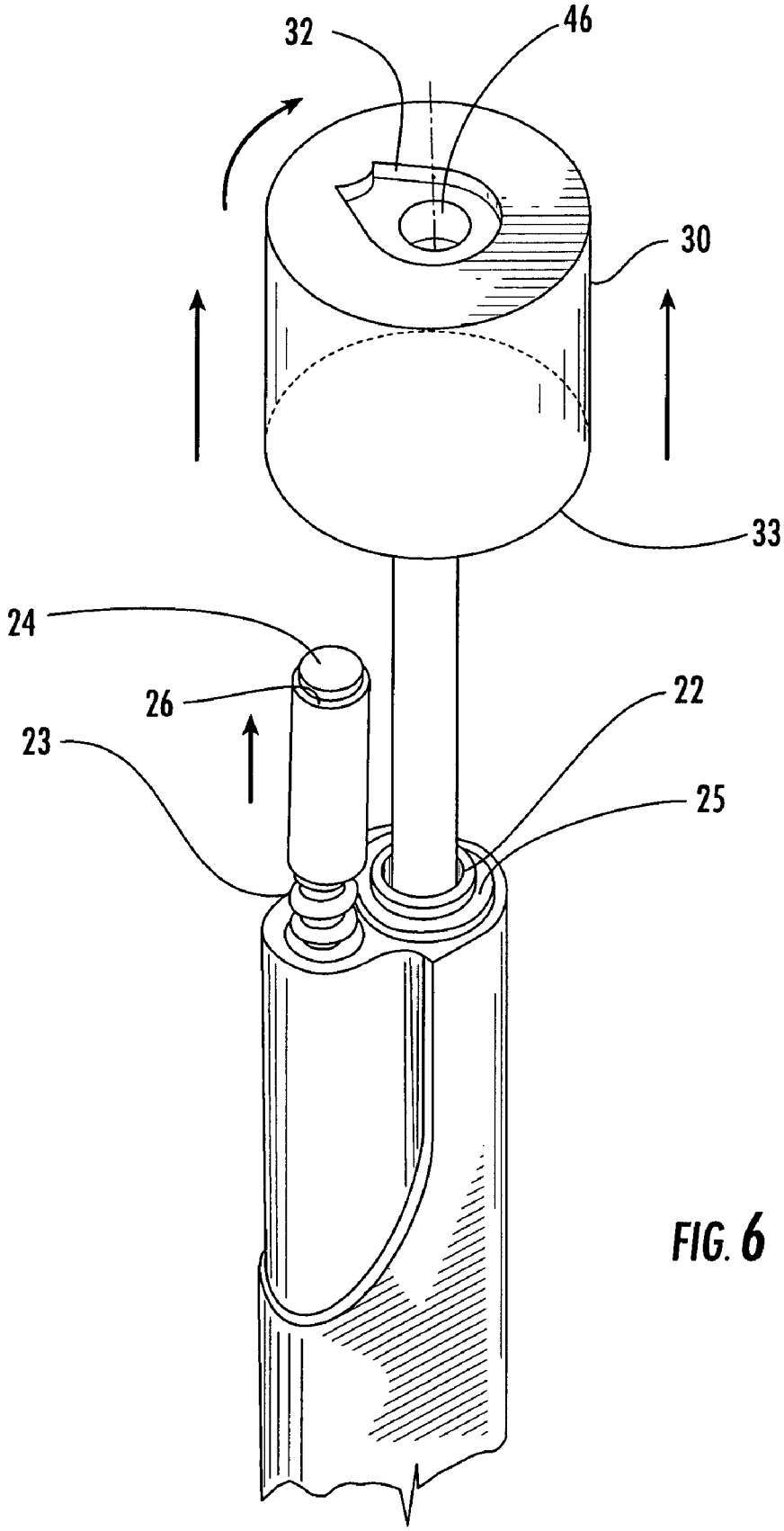

A method aspect of the invention is for assembling/disassembling the handgun 21 and may include manipulating the handle body 30 of the handgun tool 20 so that the elongate alignment member 40 carried by the handle body is positioned into the barrel 22, and so that the bushing-receiving recess 31 of the handle body engages the barrel bushing 25, as shown in FIGS. 3 and 4. The method further includes rotating the handle body 30 so that the barrel bushing 25 moves between the locked and unlocked positions (FIG. 5). This advantageously allows the spring plug 24 to be carefully removed from or pressed down into the spring cavity of the handgun 21 without unintended ejection, as shown in FIG. 6. The foregoing steps are performed in reverse order for assembly and disassembly, as will be understood by those skilled in the art.

The elongate alignment member 40 and handle body 30 may be made of numerous types of materials. Generally speaking, a relatively rigid material which resists marking or marring the handgun 21 or barrel 22 as the handle body is rotated are preferred. For example, plastic and wood are suitable materials, although other materials may be used as well. Even so, the handgun tool 20 should be used with care to avoid damaging the handgun 21 or the handgun tool 20.

In accordance with one aspect of the invention, the elongate alignment member 40 may be of a length such that it extends into the chamber of the handgun 21 as a safety measure. That is, if the chamber is loaded, the elongate alignment member 40 will not extend fully into the barrel and the bushing-receiving recess 31 will thus not contact the bushing barrel 25. Of course, shorter lengths of the elongate alignment member 40 may be used in some embodiments, or the handle body 30 may be used without the elongate alignment member in other embodiments.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A handgun tool for use with a handgun comprising a barrel, a recoil spring and associated spring plug adjacent the barrel, and a barrel bushing retaining the spring plug and being rotatable between locked and unlocked positions, the handgun tool comprising:

a handle body having at least one bushing-receiving recess therein for engaging the barrel bushing and rotating the barrel bushing between the locked and unlocked positions as the handle body is rotated;

wherein the bushing-receiving recess is in the shape of said barrel bushing; and an elongate alignment member carried by said handle body to be positioned into the barrel to align rotation of said handle body with the barrel.

2. The handgun tool of claim 1 wherein said handle body has a shape defining an axis aligned with an axis of said elongate alignment member.

3. The handgun tool of claim 1 wherein said handle body has a cylindrical shape.

4. The handgun tool of claim 1 wherein said handle body has a cylindrical shape defining a radius larger than a radial extent of said at least one bushing-receiving recess.

5. The handgun tool of claim 1 wherein the at least one barrel-bushing recess comprises different-sized first and second barrel-bushing recesses.

6. The handgun tool of claim 5 wherein said handle body has opposing first and second ends; and wherein the first and second barrel-bushing recesses are on respective opposing first and second ends of said handle body.

7. The handgun tool of claim 1 wherein said handle body has opposing first and second ends; and wherein said elongate alignment member is selectively mountable to either of the opposing first and second ends of said handle body.

8. The handgun tool of claim 1 wherein said elongate alignment member comprises a shaft having a proximal end connected to said handle body and a distal end.

9. The handgun tool of claim 8 further comprising a cleaning attachment carried by the distal end of said shaft.

10. A handgun tool for use with handguns comprising a barrel, a recoil spring and associated spring plug adjacent the barrel, and a barrel bushing from among a plurality of different-sized barrel bushings retaining the spring plug and being rotatable between locked and unlocked positions, the handgun tool comprising:

a handle body having opposing first and second ends, a first barrel-bushing recess on the first end, and a second barrel-bushing recess on the second end having a different size than the first barrel-bushing recess, the first and second barrel-bushing recesses for engaging respectively-sized barrel bushings and rotating the barrel bushings between the locked and unlocked positions as the handle body is rotated;

wherein the barrel-bushing recesses are in the shape of said barrel bushing; and said handle body having a shape with a rotational axis aligned with an axis of the barrel, and the rotational axis passing through the first and second barrel bushing recesses as the handle body is rotated between the locked and unlocked positions.

11. The handgun tool of claim 10 wherein said handle body has a cylindrical shape defining a radius larger than a radial extent of said at least one bushing-receiving recess.

12. A method of assembling/disassembling a handgun comprising a barrel, a recoil spring and associated spring plug adjacent the barrel, and a barrel bushing retaining the spring plug and being rotatable between locked and unlocked positions, the method comprising:

manipulating a handle body of a handgun tool so that an elongate alignment member carried by the handle body is positioned into the barrel and so that a bushing-receiving recess of the handle body engages the barrel bushing;

wherein the bushing-receiving recess is in the shape of said barrel bushing; and rotating the handle body so that the barrel bushing moves between the locked and unlocked positions.

13. The method of claim 12 wherein the handle body has a shape defining an axis aligned with an axis of the elongate alignment member.

14. The method of claim 12 wherein the handle body has a cylindrical shape.

15. The method of claim 14 wherein the cylindrical shape defines a radius larger than a radial extent of the at least one bushing-receiving recess.

16. The method of claim 12 wherein the handle body has opposing first and second ends and respective first and second barrel-bushing recesses on the opposing first and second ends of the handle body.

17. The method of claim 12 wherein the handle body has opposing first and second ends; and wherein the elongate alignment member is selectively mountable to either of the opposing first and second ends of the handle body.

18. The method of claim 12 wherein the elongate alignment member comprises a shaft having a proximal end connected to the handle body and a distal end.

* * * * *